US009914987B2

(12) United States Patent
Snyder et al.

(10) Patent No.: US 9,914,987 B2
(45) **Date of Patent: *Mar. 13, 2018**

(54) MARTENSITIC STAINLESS STEEL STRENGTHENED BY COPPER-NUCLEATED NITRIDE PRECIPITATES

(71) Applicant: Questek Innovations, LLC, Evanston, IL (US)

(72) Inventors: David R. Snyder, Des Plaines, IL (US); Jiadong Gong, Evanston, IL (US); Jason T. Sebastian, Chicago, IL (US); James A. Wright, Los Gatos, CA (US); Herng-Jeng Jou, San Jose, CA (US); Zechariah Feinberg, Mountain View, CA (US)

(73) Assignee: QuesTek Innovations LLC, Evanston, IL (US)

( * ) Notice: Subject to any disclaimer, the term of this patent is extended or adjusted under 35 U.S.C. 154(b) by 544 days.

This patent is subject to a terminal disclaimer.

(21) Appl. No.: 14/574,611

(22) Filed: Dec. 18, 2014

(65) Prior Publication Data

US 2015/0284817 A1 Oct. 8, 2015

Related U.S. Application Data

(60) Continuation-in-part of application No. 14/462,119, filed on Aug. 18, 2014, which is a division of (Continued)

(51) Int. Cl.
*C23C 8/32* (2006.01)
*C21D 6/02* (2006.01)
(Continued)

(52) U.S. Cl.
CPC ..... *C21D 6/02* (2013.01); *C21D 6/004* (2013.01); *C21D 6/005* (2013.01); *C21D 6/007* (2013.01);
(Continued)

(58) Field of Classification Search
CPC ..... C21D 6/02; C21D 6/005; C21D 6/007; C21D 6/004; C22C 38/04; C22C 38/001;
(Continued)

(56) References Cited

U.S. PATENT DOCUMENTS 2,797,993 A 7/1957 Tanczyn
4,154,629 A * 5/1979 Asai ..... C21D 6/002 148/232
(Continued)

FOREIGN PATENT DOCUMENTS

EP 0386673 A1 9/1990
EP 0607263 B1 12/1999
(Continued)

OTHER PUBLICATIONS

Feb. 8, 2016—(PCT)—International Search Report and Written Opinion—App PCT/US2015/027073.
(Continued)

*Primary Examiner* — Kiley Stoner
(74) *Attorney, Agent, or Firm* — Banner & Witcoff, Ltd.

(57) ABSTRACT

A martensitic stainless steel alloy is strengthened by copper-nucleated nitride precipitates. The alloy includes, in combination by weight percent, about 10.0 to about 12.5 Cr, about 2.0 to about 7.5 Ni, up to about 17.0 Co, about 0.6 to about 1.5 Mo, about 0.5 to about 2.3 Cu, up to about 0.6 Mn, up to about 0.4 Si, about 0.05 to about 0.15 V, up to about 0.10 N, up to about 0.035 C, up to about 0.01 W, and the balance Fe and incidental elements and impurities. The nitride precipitates may be enriched by one or more transition metals. A case hardened, corrosion resistant variant has a reduced weight percent of Ni, enabling increased use of Cr, and decreased Co.

19 Claims, 5 Drawing Sheets

Related U.S. Application Data application No. 12/937,348, filed as application No. PCT/US2009/040351 on Apr. 13, 2009, now Pat. No. 8,808,471.

(60) Provisional application No. 61/044,355, filed on Apr. 11, 2008.

(51) Int. Cl.

| | |
|---|---|
| ***C22C 38/20*** | (2006.01) |
| ***C22C 38/42*** | (2006.01) |
| ***C22C 38/44*** | (2006.01) |
| ***C22C 38/46*** | (2006.01) |
| ***C21D 6/00*** | (2006.01) |
| ***C22C 38/00*** | (2006.01) |
| ***C22C 38/02*** | (2006.01) |
| ***C22C 38/52*** | (2006.01) |
| ***C22C 38/04*** | (2006.01) |

(52) U.S. Cl.

CPC ..... *C22C 38/001* (2013.01); *C22C 38/02* (2013.01); *C22C 38/04* (2013.01); *C22C 38/20* (2013.01); *C22C 38/42* (2013.01); *C22C 38/44* (2013.01); *C22C 38/46* (2013.01); *C22C 38/52* (2013.01)

(58) Field of Classification Search

CPC ..... C22C 38/52; C22C 38/02; C22C 38/42; C22C 38/46; C22C 38/44; C22C 38/20

USPC ..... 148/318–319

See application file for complete search history.

(56) References Cited

U.S. PATENT DOCUMENTS

| | | | | | |
|---|---|---|---|---|---|
| 4,420,335 | A * | 12/1983 | Takagi | C22C 38/20 | 420/60 |
| 4,434,006 | A | 2/1984 | Kato et al. | | |
| 5,310,431 | A | 5/1994 | Buck | | |
| 5,545,269 | A * | 8/1996 | Koo | C21D 6/02 | 148/653 |
| 5,785,924 | A | 7/1998 | Beguinot et al. | | |
| 5,900,075 | A * | 5/1999 | Koo | C21D 6/02 | 148/328 |
| 6,045,633 | A | 4/2000 | Henn et al. | | |
| 6,162,389 | A * | 12/2000 | Hase | C22C 38/001 | 148/332 |
| 6,228,183 | B1 * | 5/2001 | Bangaru | C22C 38/04 | 148/320 |
| 6,245,290 | B1 * | 6/2001 | Koo | C21D 8/0226 | 148/335 |
| 6,248,191 | B1 * | 6/2001 | Luton | C21D 1/19 | 148/653 |
| 6,264,760 | B1 * | 7/2001 | Tamehiro | C21D 1/19 | 148/330 |
| 6,764,647 | B2 * | 7/2004 | Aigner | C21D 8/005 | 148/650 |
| 7,160,399 | B2 | 1/2007 | Kuehmann et al. | | |
| 7,186,304 | B2 * | 3/2007 | Chin | C22C 38/30 | 148/218 |
| 7,235,212 | B2 | 6/2007 | Kuehmann et al. | | |
| 7,887,645 | B1 * | 2/2011 | Schoen | C21D 8/12 | 148/111 |
| 8,715,432 | B2 * | 5/2014 | Hasegawa | C21D 8/02 | 148/331 |
| 2002/0139449 | A1 * | 10/2002 | Goecmen | C21D 1/78 | 148/327 |
| 2003/0102057 | A1 | 6/2003 | Short | | |
| 2004/0096351 | A1 * | 5/2004 | Suzuki | C21D 6/002 | 420/60 |
| 2004/0191109 | A1 * | 9/2004 | Maziasz | C22C 38/001 | 420/45 |
| 2006/0096671 | A1 * | 5/2006 | Sano | C22C 38/02 | 148/320 |
| 2008/0251166 | A1 * | 10/2008 | Han | C22C 38/002 | 148/624 |
| 2009/0277539 | A1 * | 11/2009 | Kimura | C21D 8/0205 | 148/504 |
| 2016/0040262 | A1 * | 2/2016 | Snyder | C21D 8/005 | 420/38 |

FOREIGN PATENT DOCUMENTS

| | | | | |
|---|---|---|---|---|
| EP | 1158065 | | 11/2001 | |
| EP | 1602744 | B1 * | 3/2009 | C22C 38/30 |
| GB | 2179675 | A | 3/1987 | |
| WO | WO 9840180 | A1 * | 9/1998 | C21D 6/002 |
| WO | 03018856 | A2 | 3/2003 | |
| WO | 2006068610 | A1 | 6/2006 | |
| WO | 2006081401 | A2 | 8/2006 | |
| WO | 2009126954 | A2 | 10/2009 | |

OTHER PUBLICATIONS

Oct. 21, 2010—(PCT) International Preliminary Report—PCT/US2009/040351.

Mar. 18, 2010—(PCT)—International Search Report and Written Opinion—PCT/US2009/040351.

Ageev V S; Vil'Danova N F; Kozlov K A; Kochetkova T N; Nikitina A A; Sagaradze V V; Safronov B V; Tsvelev VV; Chukanov A P: "Structure and thermal creep of the oxide-dispersion-strengthened EP-450 reactor steel" Physics of Metals and Metallography Sep. 2008—Maik Nauka-Interperiodica Publishing, vol. 106, No. 3, Sep. 2008 (Sep. 2008), pp. 318-325, XP002571196 RU ISSN: 0031-918X DOI: 10. 1134/S0031918X08090123.

Frandsen R B et al: "Simultaneous surface engineering and bulk hardening of precipitation hardening stainless steel" Surface and Coatings Technology, Elsevier, Amsterdam, NL, vol. 200, No. 16-17, Apr. 27, 2006 (Apr. 27, 2006), pp. 5160-5169, XP024995358 ISSN: 0257-8972 DOI: 10.1016/j.surfcoat.2005.04.038 [retrieved on Apr. 27, 2006].

Jun. 21, 2017—U.S. Non-Final Office Action—U.S. Appl. No. 14/462,119.

Jul. 6, 2017—U.S. Non-Final Office Action—U.S. Appl. No. 14/691,956.

* cited by examiner

N63-2X Data/properties

| Table 1<br>Processing Path | Table 2 and 3<br>Processing Path |
|---|---|
| Vacuum Melting and Casting<br>• Deliberate alloying with Nitrogen during melting | Vacuum Melting and Casting<br>• Conventional melting with no deliberate Nitrogen |
| ↓ | ↓ |
| Homogenization and Forging (or HIP) | Homogenization and Forging (or HIP) |
| ↓ | ↓ |
| Solution Treatment | Solution Treatment in Nitrogen<br>• "Solution Nitriding" to input nitrogen into case layer |
| ↓ | ↓ |
| Temper<br>• "Secondary Hardening" to precipitate Cu+$M_2N$ | Temper<br>• "Secondary Hardening" to precipitate Cu+$M_2N$ for case hardness |

FIGURE 6

MARTENSITIC STAINLESS STEEL STRENGTHENED BY COPPER-NUCLEATED NITRIDE PRECIPITATES

CROSS-REFERENCE TO RELATED APPLICATIONS

This application is a continuation-in-part which claims priority and the benefit of pending U.S. application Ser. No. 14/462,119, filed Aug. 1, 2014; which is a divisional of U.S. patent application Ser. No. 12/937,348, filed Nov. 29, 2010, now U.S. Pat. No. 8,808,471, issued Aug. 19, 2014, which is a national stage application of PCT Application No. PCT/US2009/40351, filed Apr. 13, 2009, which is the non-provisional of and claims priority to provisional U.S. Application No. 61/044,355, filed Apr. 11, 2008, all of which are incorporated by reference herein and made part hereof.

FEDERALLY SPONSORED RESEARCH AND DEVELOPMENT

This invention may be subject to governmental license rights pursuant to Marine Corps Systems Command Contract No. M67854-05-C-0025, Navy Contract No. N68335-12-C-0248 and Navy Contract No. N68335-13-0280.

BACKGROUND

The material properties of secondary-hardened carbon stainless steels are often limited by cementite precipitation during aging. Because the cementite is enriched with alloying elements, it becomes more difficult to fully dissolve the cementite as the alloying content of elements such as chromium increases. Undissolved cementite in the steel can limit toughness, reduce strength by gettering carbon, and act as corrosion pitting sites.

Cementite precipitation could be substantially suppressed in stainless steels by substituting nitrogen for carbon. There are generally two ways of using nitrogen in stainless steels for strengthening: (1) solution-strengthening followed by cold work; or (2) precipitation strengthening. Cold worked alloys are not generally available in heavy cross-sections and are also not suitable for components requiring intricate machining. Therefore, precipitation strengthening is often preferred to cold work. Precipitation strengthening is typically most effective when two criteria are met: (1) a large solubility temperature gradient in order to precipitate significant phase fraction during lower-temperature aging after a higher-temperature solution treatment, and (2) a fine-scale dispersion achieved by precipitates with lattice coherency to the matrix.

These two criteria are difficult to meet in conventional nitride-strengthened martensitic steels. The solubility of nitrogen is very low in the high-temperature bcc-ferrite matrix. And in austenitic steels, nitrides such as $M_2N$ are not coherent with the fcc matrix. Thus, there has developed a need for a martensitic steel strengthened by nitride precipitates.

Ideally, such steels will be corrosion resistant and exhibit high case hardness accompanied by excellent core properties including tensile yield strength above 150 ksi, tensile ultimate strength above 190 ksi, high fracture toughness and good elongation properties.

BRIEF SUMMARY

Aspects of the present invention relate to a martensitic stainless steel strengthened by copper-nucleated nitride precipitates. According to some aspects, the steel substantially excludes cementite precipitation during aging. Cementite precipitation can significantly limit strength and toughness in the alloy.

According to other aspects, the steel of the present invention is suitable for casting techniques such as sand casting, because the solidification range is decreased, nitrogen bubbling can be substantially avoided during the solidification, and hot shortness can also be substantially avoided. For some applications, the steel can be produced using conventional low-pressure vacuum processing techniques known to persons skilled in the art. The steel can also be produced by processes such as high-temperature nitriding, powder metallurgy possibly employing hot isostatic pressing, and pressurized electro slag remelting.

According to another aspect, a martensitic stainless steel includes, in combination by weight percent, about 10.0 to about 12.5 Cr, about 2.0 to about 7.5 Ni, up to about 17.0 Co, about 0.6 to about 1.5 Mo, about 0.5 to about 2.3 Cu, up to about 0.6 Mn, up to about 0.4 Si, about 0.05 to about 0.15 V, up to about 0.10 N, up to about 0.035 C, up to about 0.01 W, and the balance Fe.

According to another aspect, a martensitic stainless steel includes, in combination by weight percent, about 10.0 to about 14.5 Cr, about 0.3 to about 7.5 Ni, up to about 17.0 Co, about 0.6 to about 1.5 Mo, about 0.25 to about 2.3 Cu, up to about 0.6 Mn, up to about 0.4 Si, about 0.05 to about 0.15 V, up to about 0.10 N, Carbon up to about 0.2 C, up to about 0.01 W, and the balance Fe and wherein the alloy is case hardened with a primarily martensitic microstructure preferably in the range of at least about 90% by volume.

Another aspect of the invention is to provide a martensitic stainless steel embodiment which is corrosion resistant, which may be case hardened with a primarily martensitic case layer strengthened by copper-nucleated nitride precipitates.

BRIEF DESCRIPTION OF THE DRAWINGS

FIG. 6 is a flow diagram or graphical representation of the method or processing of the disclosed alloy to achieve core and case properties.

DETAILED DESCRIPTION

Figure 1:
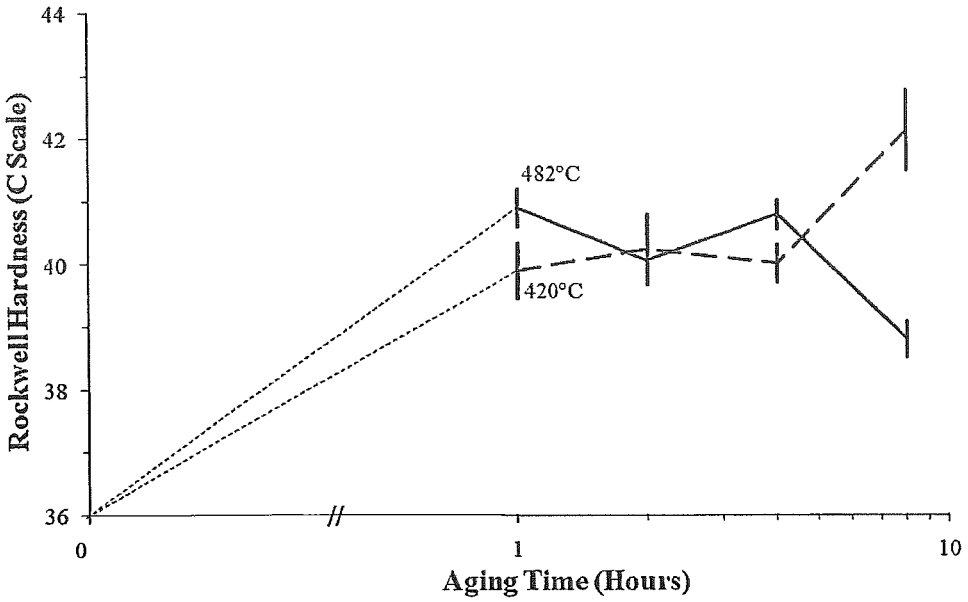
FIG. 1 is a graph illustrating the Rockwell C-scale hardness of an embodiment of an alloy according to the present invention, at specified aging conditions.

In one embodiment, a steel alloy includes, in combination by weight percent, about 10.0 to about 14.5 Cr, about 2.0 to about 7.5 Ni, up to about 17.0 Co, about 0.6 to about 1.5 Mo, about 0.25 to about 2.3 Cu, up to about 0.6 Mn, up to about 0.4 Si, about 0.05 to about 0.15 V, up to about 0.10 N, up to about 0.2 C, up to about 0.01 W, and the balance Fe and incidental elements and impurities. In another embodiment, the alloy includes, in combination by weight percent, about 10.0 to about 12.0 Cr, about 6.5 to about 7.5 Ni, up to about 4.0 Co, about 0.7 to about 1.3 Mo, about 0.5 to about 1.0 Cu, about 0.2 to about 0.6 Mn, about 0.1 to about 0.4 Si, about 0.05 to about 0.15 V, up to about 0.09 N, about 0.005 to about 0.035 C, and the balance Fe and incidental elements and impurities. In this embodiment, the content of cobalt is minimized below 4 wt % and an economic sand-casting process is employed, wherein the steel casting is poured in a sand mold, which can reduce the cost of producing the steel. It is understood that a greater amount of cobalt can be used in this embodiment. For example, secondary-hardened carbon stainless steels disclosed in U.S. Pat. Nos. 7,160,399 and 7,235,212, which are incorporated by reference herein and made part hereof, have a cobalt content up to about 17 weight percent. To establish a nitride-strengthened analogue of carbide-strengthened stainless steels, a cobalt content of up to about 17 weight percent may be utilized in this embodiment.

To be suitable for sand-casting, the solidification temperature range is minimized in this embodiment. During this solidification, nitrogen bubbling can be avoided by deliberately choosing the amount of alloying additions, such as chromium and manganese, to ensure a high solubility of nitrogen in the austenite. The very low solubility of nitrogen in bcc-ferrite phase can present an obstacle to the production of nitride-strengthened martensitic stainless steels. To overcome this challenge, one embodiment of the disclosed steel solidifies into fcc-austenite instead of bcc-ferrite, and further increases the solubility of nitrogen with the addition of chromium. The solidification temperature range and the desirable amount of chromium can be computed with thermodynamic database and calculation packages such as Thermo-Calc® software and the kinetic software DICTRA™ (DIffusion Controlled TRAnsformations) version 24 offered by Thermo-Calc Software. In another embodiment, the cast steel subsequently undergoes a hot isostatic pressing at 1204° C. and 15 ksi Ar for 4 hours to minimize porosity.

Compared to conventional nitride-strengthened steels, embodiments of the disclosed steel alloy have substantially increased strength and avoided embrittlement under impact loading. In one embodiment, the steel exhibits a tensile yield strength of about 1040 to 1360 MPa, an ultimate tensile strength of about 1210 to 1580 MPa, and an ambient impact toughness of at least about 10 ft·lb. In another embodiment, the steel exhibits an ultimate tensile strength of 1240 MPa (180 ksi) with an ambient impact toughness of 19 ft·lb. Upon quenching from a solution heat treatment, the steel transforms into a principally lath martensitic matrix. To this end, the martensite start temperature ($M_s$) is designed to be at least about 50° C. in one embodiment, and at least about 150° C. in another embodiment. During subsequent aging, a copper-based phase precipitates coherently. Nanoscale nitride precipitates enriched with transition metals such as chromium, molybdenum, and vanadium, then nucleate on these copper-based precipitates. In one embodiment, these nitride precipitates have a structure of $M_2N$, where M is a transition metal. Additionally, in this embodiment, the nitride precipitates have a hexagonal structure with two-dimensional coherency with the martensite matrix in the plane of the hexagonal structure. The hexagonal structure is not coherent with the martensite matrix in the direction normal to the hexagonal plane, which causes the nitride precipitates to grow in an elongated manner normal to the hexagonal plane in rod or column form. In one embodiment, the copper-based precipitates measure about 5 nm in diameter and may contain one or more additional alloying elements such as iron, nickel, chromium, cobalt, and/or manganese. These alloying elements may be present only in small amounts. The copper-based precipitates are coherent with the martensite matrix in this embodiment.

In one embodiment, high toughness can be achieved by controlling the nickel content of the matrix to ensure a ductile-to-brittle transition sufficiently below room temperature. The Ductile-to-Brittle Transition Temperature (DBTT) can be decreased by about 16° C. per each weight percent of nickel added to the steel. However, each weight percent of nickel added to the steel can also undesirably decrease the $M_s$ by about 28° C. Thus, to achieve a DBTT below room temperature while keeping the $M_s$ above about 5° C., the nickel content in one embodiment is about 6.5 to about 7.5 Ni by weight percent. This embodiment of the alloy shows a ductile-to-brittle transition at about −15° C. The toughness can be further enhanced by a fine dispersion of VN grain-refining particles that are soluble during homogenization and subsequently precipitate during forging.

The alloy may be subjected to various heat treatments to achieve the martensite structure and allow the copper-based precipitates and nitride precipitates to nucleate and grow. Such heat treatments may include hot isostatic pressing, a solutionizing heat treatment, and/or an aging heat treatment. In one embodiment, any heat treatment of the alloy is conducted in a manner that passes through the austenite phase and avoids formation of the ferrite phase. As described above, the ferrite phase has low nitrogen solubility, and can result in undissolved nitrogen escaping the alloy.

Table 1 lists various alloy compositions according to different embodiments of the invention. In various embodiments of the alloy described herein, the material can include a variance in the constituents in the range of plus or minus 5 percent of the stated value, which is signified using the term "about" in describing the composition. Table 1 discloses mean values for each of the listed alloy embodiments, and incorporates a variance of plus or minus 5 percent of each mean value therein. Additionally, an example is described below utilizing the alloy embodiment identified as Steel A in Table 1.

TABLE 1

| | wt % | | | | | | | | | | | |
|---|---|---|---|---|---|---|---|---|---|---|---|---|
| | Fe | C | Co | Cr | Cu | Ni | Mo | Mn | N | Si | V | W |
| Steel A | Bal. | 0.015 | 3.0 | 11.0 | 0.8 | 7.0 | 1.0 | 0.5 | 0.08 | 0.3 | 0.1 | 0.01 |
| Steel B | Bal. | 0.015 | — | 12.5 | 1.9 | 2.0 | 0.7 | 0.5 | 0.10 | 0.3 | 0.1 | — |
| Steel C | Bal. | 0.015 | — | 11.0 | 2.3 | 2.0 | 0.6 | 0.5 | 0.08 | 0.3 | 0.1 | — |
| Steel D | Bal. | 0.015 | — | 12.5 | 1.9 | 3.0 | 1.5 | 0.5 | 0.10 | 0.3 | 0.1 | — |
| Steel E | Bal. | 0.015 | — | 11.0 | 0.8 | 6.2 | 1.0 | 0.5 | 0.08 | 0.3 | 0.1 | — |

Example 1: Steel A

Figure 2:
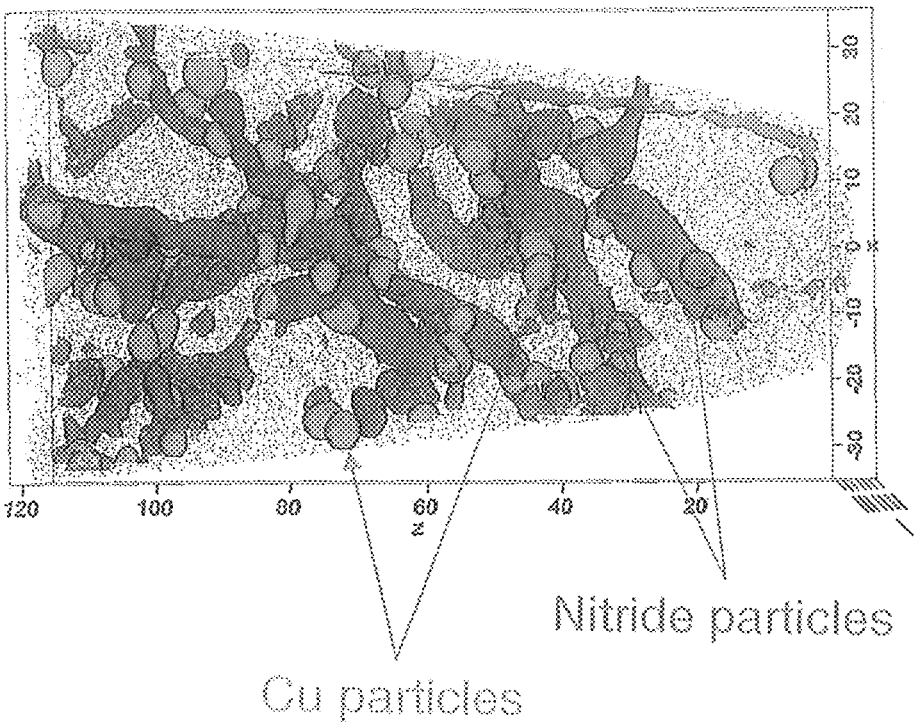
FIG. 2 is a three-dimensional computer reconstruction of a microstructure of an embodiment of an alloy according to the present invention, produced using atom-probe tomography.

Steel A was sand cast, and nitrogen-bearing ferro-chrome was added during, melt. The casting weighed about 600 pounds. The $M_s$ for this steel was confirmed as 186° C. using dilatometry. The steel was subjected to a hot isostatic pressing at 1204° C. and 15 ksi Ar for 4 hours, solutionized at 875° C. for 1 hour, quenched with oil, immersed in liquid nitrogen for 2 hours, and warmed in air to room temperature. In the as-solutionized state, the hardness of Steel A was measured at about 36 on the Rockwell C scale. Samples of Steel A were then subjected to an isothermal aging heat treatment at temperatures between 420 and 496° C. for 2 to 32 hours. As shown in FIG. 1, tests performed after the isothermal aging showed that the hardness of the alloy increases rapidly during the isothermal aging process and remains essentially constant at all subsequent times examined. The testing also showed that aging at 482° C. results in a higher impact toughness. Aging the invented steel at 482° C. for 4 hours resulted in a desirable combination of strength and toughness for the alloy evaluated. The tensile yield strength in this condition was about 1040 to 1060 MPa (151 to 154 ksi) and ultimate tensile strength was about 1210 to 1230 MPa (176 to 179 ksi). The ambient impact toughness in this condition was about 19 ft·lb, and the ductile-to-brittle transition was at about −15° C. FIG. 2 shows an atom-probe tomography of this condition where rod-shaped nitride precipitates nucleate on spherical copper-base precipitates.

Variants of the invention facilitate manufacture of case hardened alloy articles which exhibit the superior core characteristics disclosed. The target or design compositions and the actual or measured compositions of five variants of the invention are set forth in Table 2.

casting. The variant alloys thus efficiently enable manufacture of a case hardened component with lower cobalt and nickel content thereby enhancing the opportunity for transformation into a martensitic phase at a reasonable transformation temperature while simultaneously increasing the carbon content to maintain core mechanical properties. The chromium content is increased or maintained for corrosion resistance. The inclusion of a lower cobalt content in combination with copper-nucleated nitride particles results in both surface hardening and superior core mechanical properties. Secondary hardening during tempering is achieved by the simultaneous precipitation of copper-nucleated nitride particles in the nitride case and copper-nucleated carbide particles in the core to provide the combination of surface and core properties. Processability opportunities are also enhanced inasmuch as the alloy may be worked and subsequently case hardened.

TABLE 3

| Core Mechanical Property | N63-2A (482° C. temper) | N63-2B (482° C. temper) | N63-3A (482° C. temper) | N63-3B (482° C. temper) | N63-3C (482° C. temper) |
|---|---|---|---|---|---|
| Tensile Strength (ksi) | 223 | 206 | 190 | 198 | 202 |
| Tensile Yield Strength (ksi) | 172 | 163 | 151 | 156 | 155 |
| % Elongation | 23 | 22 | 20 | 20 | 19 |
| % Reduction in Area | 71 | 73 | 64 | 71 | 59 |
| Fracture Toughness (ksi√in) | 60 | 52 | 92 | 79 | 111 |

TABLE 2

| | | Actual (measured) Chemistry Analysis (wt %) | | | | | | | | | | | | | | |
|---|---|---|---|---|---|---|---|---|---|---|---|---|---|---|---|---|
| | Wt % | C | Cr | Ni | Mo | Co | Cu | Nb | Ti | Mn | Si | Al | P | S | N | O |
| N63-2A | Design | 0.14 | 12.5 | 1.5 | 1.5 | 3 | 0.5 | 0.06 | — | — | <0.04 | — | <20 ppm | <20 ppm | <5 ppm | <60 ppm |
| | Actual | 0.138 | 12.4 | 1.40 | 1.54 | 2.78 | 0.32 | 0.053 | 0.006 | — | 0.009 | — | 5 ppm | 8 ppm | 23 ppm | 29 ppm |
| N63-2B | Design | 0.2 | 12.5 | 1.7 | 1.5 | — | 0.5 | 0.04 | — | | <0.04 | — | <20 ppm | <20 ppm | <5 ppm | <60 ppm |
| | Actual | 0.197 | 12.0 | 1.66 | 1.52 | — | 0.29 | 0.042 | 0.013 | — | 0.011 | — | 5 ppm | 9 ppm | 14 ppm | 29 ppm |
| N63-3A | Design | 0.1 | 12.5 | 1.3 | 1.3 | 3 | 0.5 | 0.05 | 0.01 | — | — | — | <20 ppm | <20 ppm | <10 ppm | <50 ppm |
| | Actual | 0.098 | 12.92 | 1.29 | 1.30 | 3.03 | 0.41 | 0.052 | 0.008 | 0.01 | 0.04 | 0.002 | 10 ppm | 13 ppm | 10 ppm | 90 ppm |
| N63-3B | Design | 0.12 | 13.5 | 1.2 | 0.9 | 3.2 | 0.3 | 0.04 | 0.01 | — | — | — | <20 ppm | <20 ppm | <10 ppm | <50 ppm |
| | Actual | 0.121 | 13.88 | 1.18 | 0.874 | 3.01 | 0.327 | 0.051 | 0.015 | 0.01 | 0.007 | 0.002 | 10 ppm | 15 ppm | 10 ppm | 100 ppm |
| N63-3C | Design | 0.15 | 13.5 | 0.4 | — | 1.7 | 0.3 | 0.04 | 0.01 | — | — | — | <20 ppm | <20 ppm | <10 ppm | <50 ppm |
| | Actual | 0.143 | 14.08 | 0.355 | 0.021 | 1.55 | 0.269 | 0.042 | 0.012 | 0.02 | 0.01 | 0.001 | 10 ppm | 16 ppm | 10 ppm | 90 ppm |
| | | Intentional alloying elements | | | | | | | | | | | Impurities/Incidentals | | | |

A distinction of the constituent range of the variant alloys of Table 2 and the range of constituents associated with the embodiments of the alloys set forth in Table 1 is the following:

Ni: expand to (at least) 0.3-7.5 wt %

Cr: expand to (at least) 10.0-14.5 wt %

Cu: expand to (at least) 0.25-2.3 wt %

C: expand to (at least) up to about 0.2 wt %

V: expand to (at least) up to about 0.15 wt %

Mo: expand to (at least) up to about 0.60-2.0 wt %

Table 3 sets forth mechanical properties associated with each of the five representative alloy variants of Table 2 including the ultimate tensile strength, tensile yield strength, percent elongation and reduction in area due to working and fracture toughness. The compositions of the disclosed embodiments result in a combination of carbon and nitrogen in wt % in the range of about 4-5.5 to 6 in the case of a Following are examples of the variant alloys:

Example 2

Figure 3:
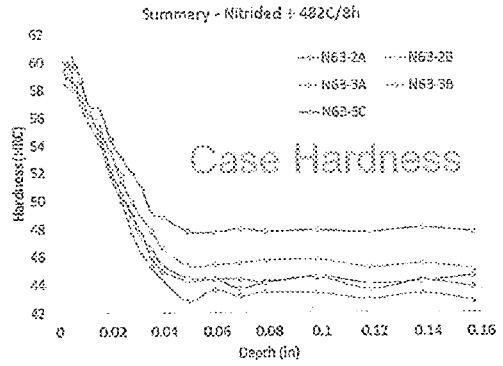
FIG. 3 is a graph depicting the case hardness of five separate examples of a variant alloy of the invention.
Figure 4:
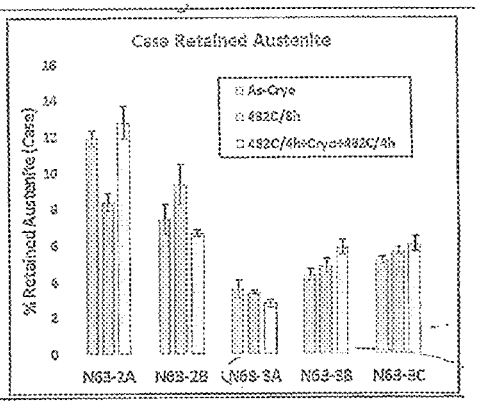
FIG. 4 is a graph depicting the quantity of retained austenite in the case of the five reported variant experimental alloys identified in Tables 2 and 3 which in turn identify the experimental and measured chemistry analysis in weight percent of the five experimental alloys illustrating the invention.

Invented steels N632A and N632B were melted as 30 lb. ingots using vacuum induction melting (VIM), and secondary melted using vacuum arc remelting (VAR). In contrast to the alloy variant of EXAMPLE 1, this variant is not melted with deliberate additions of nitrogen. Melted ingots were processed by conventional means, including homogenization in the range of 1100° C. to 1200° C. and hot rolling from a starting temperature in the range of 1100° C. to 1200° C. to form the material into plate. To introduce nitrogen into a case hardened layer, samples were nitrided at 1100° C. for about 4 hours using a low-pressure solution nitriding process, followed by gas quenching to room temperature and subsequent cryogenic treatment for martensitic transformation. Samples were subjected to an isothermal aging treatment at temperatures in the range of 420° C. to <4-96° C. for up to 32 hours, resulting in simultaneous precipitation of copper-nucleated nitride particles in the case layer and copper-nucleated carbide panicles in the core material. Testing indicated a desirable combination of case and core properties when the invented steel was aged at 482° C. for 8 hours. As set forth in Table 3, the tensile yield strength in this condition was about 1124 to 1186 MPa (163 to 172 ksi), and the ultimate tensile strength was about 1420 to 1538 MPa (206 to 223 ksi). The ambient temperature fracture toughness (measured according to ASTM E399 standards) in this condition was about 57 to 66 MPa√m (52 to 60 ksi√in). As set forth in FIG. 3, the demonstrated case hardness in this condition was about 59 to 61 on the Rockwell C scale.

Thus, the alloy variants of Table 2 are designed to be case hardenable. The alloys as described and processed with respect with Table 1 are deliberately alloyed with nitrogen during the melting process to yield a specific Carbon+Nitrogen (C+N) content to achieve a microstructure (Copper-nucleated $M_2N$ precipitation within a martensitic stainless steel) that yields specific novel properties. The variants of Table 2 alloys utilize essentially the same microstructural approach or concept (Copper-nucleated $M_2N$ precipitation within a martensitic stainless steel including the feature of matrix) to achieving high surface hardness in case-hardenable alloy, but with no deliberate nitrogen during melting. Modifications to the variant alloy design to achieve this include:

- Equivalent C+N alloying content is maintained during melting, but C is favored for conventional melt processing and core mechanical properties
- High nitrogen contents necessary for case hardness are incorporated using a secondary processing step of "Solution Nitriding". Solution nitriding results in ~0.3 wt % N in the case, maintaining a N/C ratio consistent with the alloys of Table 1.
- High surface hardness is achieved through Copper-nucleated $M_2N$ precipitation in the case during tempering
- High nitrogen content in the case lowers the martensite transformation temperature, and so nickel content is lowered to raise the Ms temperature of the case an acceptable level to avoid retained austenite phase (austenite being detrimental to surface hardness and $M_2N$ precipitation A graphical description of the processing used to create the case hardened alloys such as set forth in Table 2 vis a vis the alloy form represented by the examples in Table 1 is set forth in FIG. 6.

Figure 5:
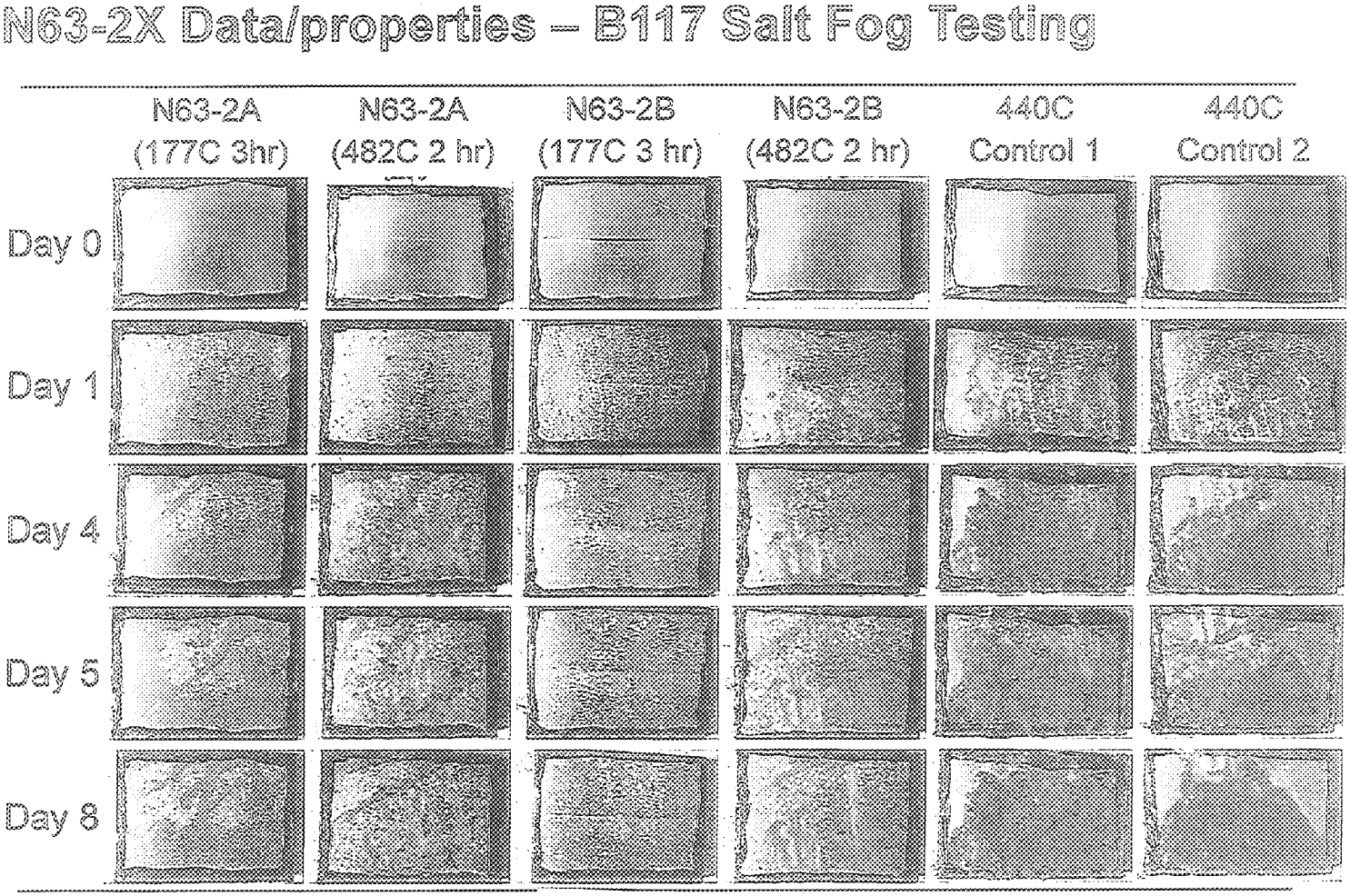
FIG. 5 is a photograph depicting the visual result of a corrosion test performed on two of the alloys of the invention in comparison to first and second control specimens.

In addition to the enhanced physical characteristics of the case and the maintenance of desirable mechanical and physical characteristics of the core, the alloys of the invention have high corrosion resistance as exemplified by FIG. 5 using a standard salt fog test wherein the alloys were exposed to hostile environments in contrast to control alloys 440C manufactured by in contrast to control alloy 440C manufactured at Latrobe Specialty Steel by double vacuum melting and in accordance with Aerospace Material Specification (AMS) 5630. The test results demonstrate the significantly improved corrosion resistance associated with the variant alloys described.

Microstructure analysis of the alloys results in a case hardened martensitic phase comprising at least about 90% by volume and typically in the range of 95% to 100% with a case thickness dependent upon the conditions of the nitriding process (in the range of 0.5 mm to 2 mm in the embodiments disclosed here).

The various embodiments of martensitic stainless steels disclosed herein provide benefits and advantages over existing steels, including existing secondary-hardened carbon stainless steels or conventional nitride-strengthened steels. For example, the disclosed steels provide a substantially increased strength and avoid embrittlement under impact loading, at attractively low material and process costs. Additionally, cementite formation in the alloy is minimized or substantially eliminated, which avoids undesirable properties that can be created by cementite formation. Accordingly, the disclosed stainless steels may be suitable for gear wheels where high strength and toughness are desirable to improve power transmission. Other benefits and advantages are readily recognizable to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. "Providing" an alloy, as used herein, refers broadly to making the alloy, or a sample thereof, available or accessible for future actions to be performed thereon, and does not connote that the party providing the alloy has manufactured, produced, or supplied the alloy or that the party providing the alloy has ownership or control of the alloy. It is further understood that the invention may be in other specific forms without departing from the spirit or central characteristics thereof. The present examples therefore are to be considered in all respects as illustrative and not restrictive, and the invention is not to be limited to the details given herein. Accordingly, while the specific examples have been illustrated and described, numerous modifications come to mind without significantly departing from the spirit of the invention and the scope of protection is only limited by the scope of the accompanying claims.

What is claimed is:

1. A case hardened martensitic stainless steel alloy strengthened by copper-nucleated nitride precipitates, said alloy comprising, in combination by weight percent, about 10.0 to about 14.5 Cr, about 0.3 to about 7.5 Ni, Co up to about 17.0 Co, about 0.6 to about 1.5 Mo, about 0.25 to about 2.3 Cu, up to about 0.6 Mn, up to about 0.4 Si, about 0.05 to about 0.15 V, up to about 0.10 N, C up to about 0.2 C, up to about 0.01 W, and the balance Fe and incidental elements and impurities, said alloy having a microstructure substantially free of cementite carbides and comprising a martensite matrix with nanoscale copper particles and alloy nitride precipitates selected from the group consisting of alloy nitride precipitates enriched with a transition metal nucleated on the copper precipitates, said alloy nitride precipitates having a hexagonal structure, said alloy nitride precipitates including one or more alloying elements selected from the group Fe, Ni, Cr, Co and Mn coherent with the matrix, and said alloy nitride precipitates having two dimensional coherency with the matrix, said alloy substantially free of cementite carbide precipitates in the form of a case hardened article of manufacture.

2. The alloy of claim 1, wherein the alloy has a core tensile yield strength of about 150 to 175 ksi, a core ultimate strength of about 190 to 225 ksi and a fracture toughness of about 50 to 115 ksi√in.

3. The alloy of claim 1, wherein the alloy has a martensite start temperature of at least about 50° C.

4. The alloy of claim 1, wherein the alloy comprises precipitates of a copper-based phase and nitride precipitates enriched with transition metals.

5. The alloy of claim 4, wherein the nitride precipitates nucleate on the copper-based phase, and comprise at least one metal selected from a group consisting of chromium, molybdenum, and vanadium.

6. The alloy of claim 1 wherein the alloy has a case hardness greater than about 59 HRC.

7. The alloy of claim 6 wherein said case includes at least about 90% of by volume martensitic matrix.

8. The alloy of claim 1 wherein the N to C ratio is in the range of about 2 to 10.

9. A case hardenable stainless steel alloy strengthened by copper-nucleated precipitates, said alloy comprising, in combination by weight percent, a melt of about 10.0 to about 14.5 Cr, about 0.3 to about 7.5 Ni, Co up to about 17.0 Co, about 0.6 to about 1.5 Mo, about 0.25 to about 2.3 Cu, up to about 0.6 Mn, up to about 0.4 Si, about 0.05 to about 0.15 V, C up to about 0.2 C, up to about 0.01 W, and the balance Fe and incidental elements and impurities, and having a hardenable case effected by the addition of up to about 0.10 N with a resulting microstructure substantially free of cementite carbides and comprising a martensite matrix with nanoscale copper particles and alloy nitride precipitates selected from the group consisting of alloy nitride precipitates enriched with a transition metal nucleated on the copper precipitates, said alloy nitride precipitates having a hexagonal structure, said alloy nitride precipitates including one or more alloying elements selected from the group Fe, Ni, Cr, Co and Mn coherent with the matrix, wherein the N is incorporated in said alloy by at least one processing step selected from the group consisting of (a) inclusion in the melt, and (b) subsequent addition of N by solution treatment of the cast melt and tempering.

10. The alloy of claim 9, wherein the alloy comprises precipitates of a copper-based phase and nitride precipitates enriched with transition metals.

11. The alloy of claim 10, wherein the nitride precipitates nucleate on the copper-based phase, and comprise at least one metal selected from a group consisting of chromium, molybdenum, and vanadium.

12. The alloy of claim 9 wherein the alloy has a case hardness greater than about 59 HRC.

13. The alloy of claim 12 wherein said case includes at least about 90% of by volume martensitic matrix.

14. The alloy of claim 9 wherein the N to C ratio is in the range of about 2 to 10.

15. The alloy of claim 9 wherein said alloy has a case hardness of at least about 48 HRC at a case depth of 0.02 inches.

16. A case hardened martensitic, stainless steel alloy in the form of an article of manufacture strengthened by copper-nucleated nitride precipitates, said alloy comprising, in combination by weight percent, about 10.0 to about 14.5 Cr, about 0.3 to about 7.5 Ni, Co up to about 17.0 Co, about 0.6 to about 1.5 Mo, about 0.25 to about 2.3 Cu, up to about 0.6 Mn, up to about 0.4 Si, about 0.05 to about 0.15 V, up to about 0.10 N, C up to about 0.2 C, up to about 0.01 W, and the balance Fe and incidental elements and impurities, said alloy having a microstructure substantially free of cementite carbides and comprising a martensite matrix with nanoscale copper particles and alloy nitride precipitates selected from the group consisting of alloy nitride precipitates enriched with a transition metal nucleated on the copper precipitates, said alloy nitride precipitates having a hexagonal structure, said alloy nitride precipitates including one or more alloying elements selected from the group Fe, Ni, Cr, Co and Mn coherent with the matrix.

17. The alloy of claim 16, wherein the alloy has a core tensile yield strength of about 150 to 175 ksi, a core ultimate strength of about 190 to 225 ksi and a fracture toughness of about 50 to 115 ksi$\sqrt{\text{in}}$.

18. The alloy of claim 16, wherein the alloy has a martensite start temperature of at least about 50° C.

19. The alloy of claim 16, wherein the alloy comprises precipitates of a copper-based phase and nitride precipitates enriched with transition metals.

* * * * *